US008564526B2

(12) United States Patent
Shiu et al.

(10) Patent No.: US 8,564,526 B2
(45) Date of Patent: Oct. 22, 2013

(54) SOURCE DRIVER AND DISPLAY APPARATUS

(75) Inventors: Cheng-Lin Shiu, Miaoli (TW); Jing-Yuan Zheng, Miaoli (TW)

(73) Assignee: Fitipower Integrated Technology, Inc., Hsinchu (TW)

( * ) Notice: Subject to any disclaimer, the term of this patent is extended or adjusted under 35 U.S.C. 154(b) by 292 days.

(21) Appl. No.: 13/175,850

(22) Filed: Jul. 2, 2011

(65) Prior Publication Data

US 2012/0038599 A1 Feb. 16, 2012

(30) Foreign Application Priority Data

Aug. 13, 2010 (TW) ..... 99127028 A

(51) Int. Cl.
*G09G 3/36* (2006.01)

(52) U.S. Cl.
USPC ..... 345/100

(58) Field of Classification Search
USPC ..... 345/100, 98
See application file for complete search history.

(56) References Cited

U.S. PATENT DOCUMENTS

| | | | | |
|---|---|---|---|---|
| 7,310,079 | B2 * | 12/2007 | Chen et al. | 345/87 |
| 7,327,344 | B2 * | 2/2008 | Asada et al. | 345/100 |
| 2007/0046614 | A1 * | 3/2007 | Chien | 345/100 |
| 2007/0290983 | A1 * | 12/2007 | Kim et al. | 345/100 |
| 2009/0015297 | A1 * | 1/2009 | Chen et al. | 327/108 |
| 2010/0164926 | A1 | 7/2010 | Huang et al. | |

* cited by examiner

*Primary Examiner* — Chanh Nguyen
*Assistant Examiner* — Roy Rabindranath
(74) *Attorney, Agent, or Firm* — Altis & Wispro Law Group, Inc.

(57) ABSTRACT

A source driver includes a first output buffer, a second output buffer, a first output switch, a second output switch, a third output switch, a fourth output switch, a first resistor, a second resistor, a third resistor, a fourth resistor, a first charge-sharing switch. The first and the second output buffer respectively enhances a first and a second pixel signal and respectively outputs a first and a second enhanced pixel signal to a display panel. The first output switch and the first resistor connected in series and the second output switch and the second resistor connected in series are connected in parallel between the first output buffer and the display panel. The third output switch and the third resistor connected in series and the fourth output switch and the fourth resistor connected in series are connected in parallel between the second output buffer and the display panel.

18 Claims, 3 Drawing Sheets

SOURCE DRIVER AND DISPLAY APPARATUS

BACKGROUND

1. Technical Field

The disclosed embodiments relate to source drivers, and more particularly to a source driver and a display apparatus.

2. Description of Related Art

Referring to FIG. 3, a source driver 900 includes a first output buffer 12, a second output buffer 14, a first output switch 16, a second output switch 18, a charge-sharing switch 20, a first resistor R1, and a second resistor R2. The first output buffer 12 is used for enhancing a first pixel signal and outputting a first enhanced pixel signal, and the second output buffer 14 is used for enhancing a second pixel signal and outputting a second enhanced pixel signal. The first output switch 16 and the second output switch 18 are simultaneously controlled by a first control signal, and the charge-sharing switch 20 is controlled by a second control signal. The first resistor R1 and the second resistor R2 are electrostatic discharge (ESD) protection resistors, and the resistance of each of the ESD protection resistors is R.

When the first control signal is changed to a high level, the first output switch 16 and the second output switch 18 are turned on, the charge-sharing switch 20 is cut off by the second control signal, the system enters into an output timing mode T1. In the output timing mode T1, the first enhanced pixel signal and the second enhanced pixel signal drives a display panel respectively through the first resistor R1 and the second resistor R2.

Next, the first control signal is changed from the high level to a low level, the first output switch 16 and the second output switch 18 are cut off, the charge-sharing switch 20 is turned on by the second control signal, the system enters into a charge-sharing timing mode T2. The resistance of the first resistor R1 and the second resistor R2 affect the efficiency of charge sharing during the charge-sharing timing mode T2, when the resistance of the first resistor R1 and the second resistor R2 are larger, the time taken by the electric potential of a first output terminal 24 and a second output terminal 25 to reach the intermediate value is longer, so the efficiency of the charge sharing is lower. During the output timing mode T1, the resistance of the first resistor R1 and the second resistor R2 limit the driving ability of the source driver 900, when the resistance of the first resistor R1 and the second resistor R2 are larger, the time taken by the electric potential of the first output terminal 24 and the second output terminal 25 to reach the final value is longer.

However, assuming the resistance of the equivalent resistor of the output switch and the ESD protection resistor are reduced, the driving ability and the efficiency of the charge sharing of the source driver can be improved, but the ESD protection of the source driver becomes worse.

Therefore, there is room for improvement in the art.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout three views.

DETAILED DESCRIPTION

Figure 1:
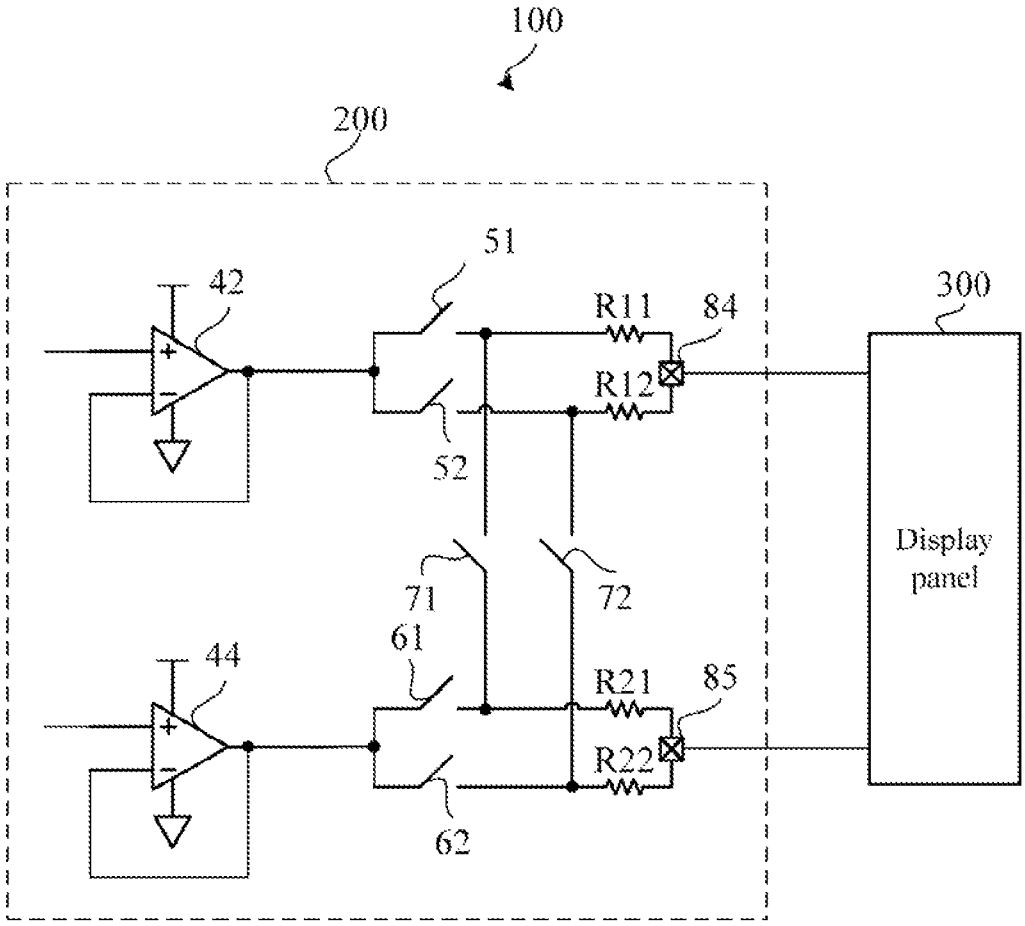
FIG. 1 is a schematic diagram of a display apparatus in accordance with a first embodiment.

Referring to FIG. 1, a display apparatus 100 includes a source driver 200 and a display panel 300. The source driver 200 includes a first output buffer 42, a second output buffer 44, a first output switch 51, a second output switch 52, a third output switch 61, a fourth output switch 62, a first resistor R11, a second resistor R12, a third resistor R21, a fourth resistor R22, a first charge-sharing switch 71, and a second charge-sharing switch 72. The first output buffer 42 is used for enhancing a first pixel signal and outputting a first enhanced pixel signal. The second output buffer 44 is used for enhancing a second pixel signal and outputting a second enhanced pixel signal. The first output buffer 42 and the second output buffer 44, for example, are implemented by operational amplifiers. The first resistor R11, the second resistor R12, the third resistor R21, and the fourth resistor R22 are electrostatic discharge (ESD) protection resistors, and the resistance of each of the ESD protection resistors is R.

One end of the first output switch 51 is coupled to the first output buffer 42, one end of the second output switch 52 is coupled to the first output buffer 42. The first resistor R11 is coupled between the other end of the first output switch 51 and the display panel 300, the second resistor R12 is coupled between the other end of the second output switch 52 and the display panel 300. One end of the third output switch 61 is coupled to the second output buffer 44, and one end of the fourth output switch 61 is coupled to the second output buffer 44. The third resistor R21 is coupled between the other end of the third output switch 61 and the display panel 300. The fourth resistor R22 is coupled between the other end of the fourth output switch 62 and the display panel 300. One end of the first charge-sharing switch 71 is coupled between the first output switch 51 and the first resistor R11, the other end of the first charge-sharing switch 71 is coupled between the third output switch 61 and the third resistor R21. One end of the second charge-sharing switch 72 is coupled between the second output switch 52 and the second resistor R12, the other end of the second charge-sharing switch 72 is coupled between the fourth output switch 62 and the fourth resistor R22. The first charge-sharing switch 71 and the second charge-sharing switch 72 perform a charge sharing function on the display panel 300.

In this embodiment, the first output switch 51, the second output switch 52, the third output switch 61, and the fourth output switch 62 are simultaneously turned on or cut off by a first control signal. The first charge-sharing switch 71 and the second charge-sharing switch 72 are simultaneously turned on or cut off by a second control signal. In other embodiments, the first output switch 51 and the third output switch 61 are simultaneously turned on or cut off by a third control signal, the second output switch 52 and the fourth output switch 62 are simultaneously turned on or cut off by a fourth control signal different from the third control signal.

The principle of the source driver 200 is illustrated as follows:

When the first control signal is changed to a high level, the first output switch 51, the second output switch 52, the third output switch 61, and the fourth output switch 62 are turned on, the first charge-sharing switch 71 and the second charge-sharing switch 72 is cut off by the second control signal, the system enters into an output timing mode T1. In the output timing mode T1, the first output buffer 42 outputs the first enhanced pixel signal to the display panel 300 through the first output switch 51 and the first resistor R11, and outputs the first enhanced pixel signal to the display panel 300 through the second output switch 52 and the second resistor R12. The second output buffer 44 outputs the second enhanced pixel signal to the display panel 300 through the third output switch 61 and the third resistor R21, and outputs the second enhanced pixel signal to the display panel 300 through the fourth output switch 62 and the fourth resistor R22. Because the first resistor R11 and the second resistor R12 are coupled in parallel, the resistance of each of the first resistor R11 and the second resistor R12 is R, compared to conventional source driver 900, the resistance between the first output buffer 42 and the display panel 300 is reduced, the resistance between the second output buffer 44 and the display panel 300 is also reduced, therefore, the driving ability of the source driver 100 is enhanced.

Figure 2:
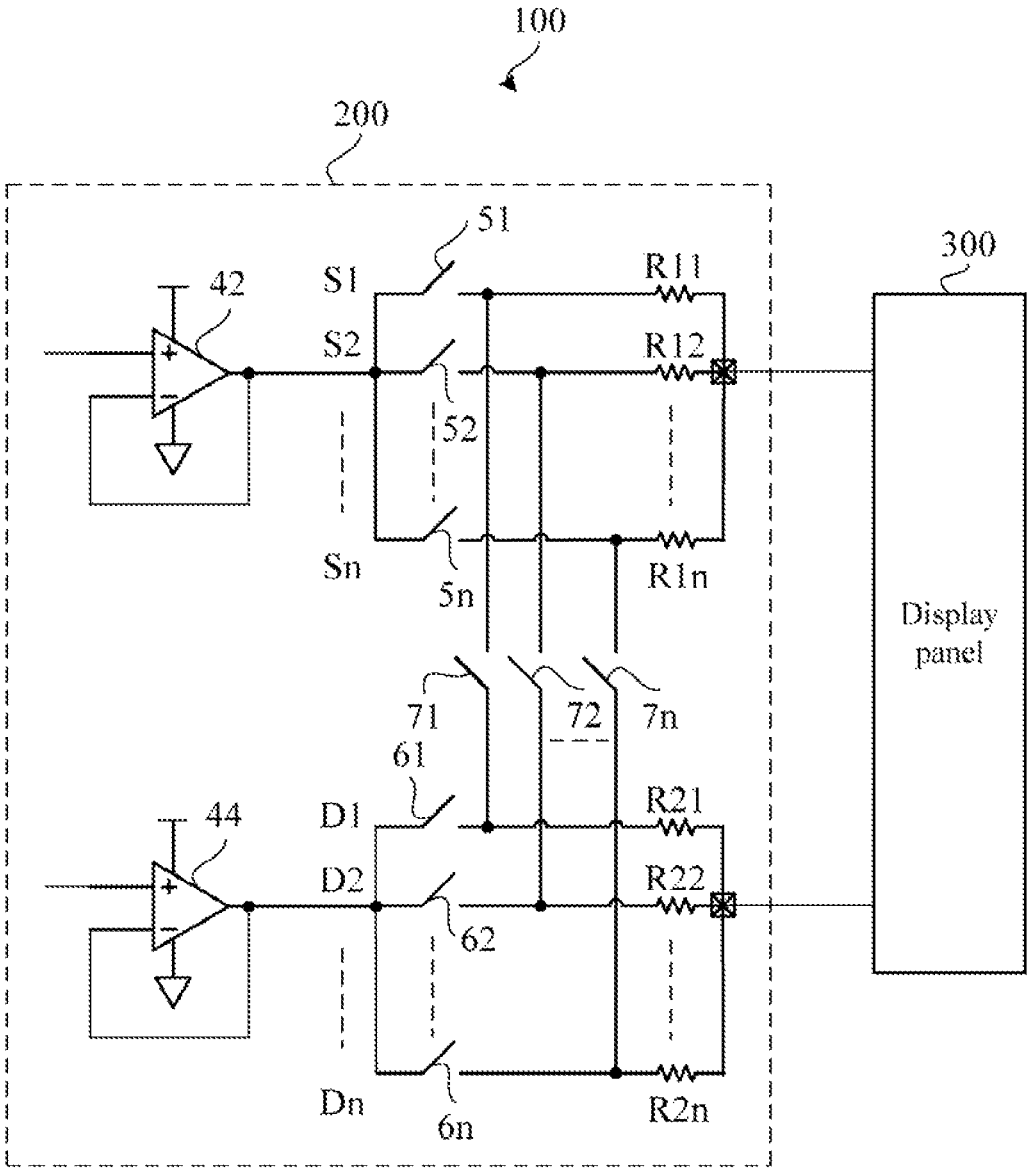
FIG. 2 is a schematic diagram of a display apparatus in accordance with a second embodiment.

Next, the first control signal is changed from the high level to a low level, the first output switch 51, the second output switch 52, the third output switch 61, and the fourth output switch 62 are cut off, the first charge-sharing switch 71 and the second charge-sharing switch 72 are turned on by the second control signal, the system enters into the charge-sharing timing mode T2. In the charge-sharing timing mode T2, referring to FIG. 1, in conventional source driver 900, the resistance between the first output terminal 24 and the second output terminal 25 is 2R. Referring to FIG. 2, in source driver 200, the resistance between the first output terminal 84 and the second output terminal 85 is R, the resistance is reduced. Compared to conventional source driver 900, the time taken by the electric potential of the first output terminal 84 and the second output terminal 85 to reach the intermediate value is shorter. Therefore, the charge sharing of the source driver 200 is enhanced.

Figure 3:
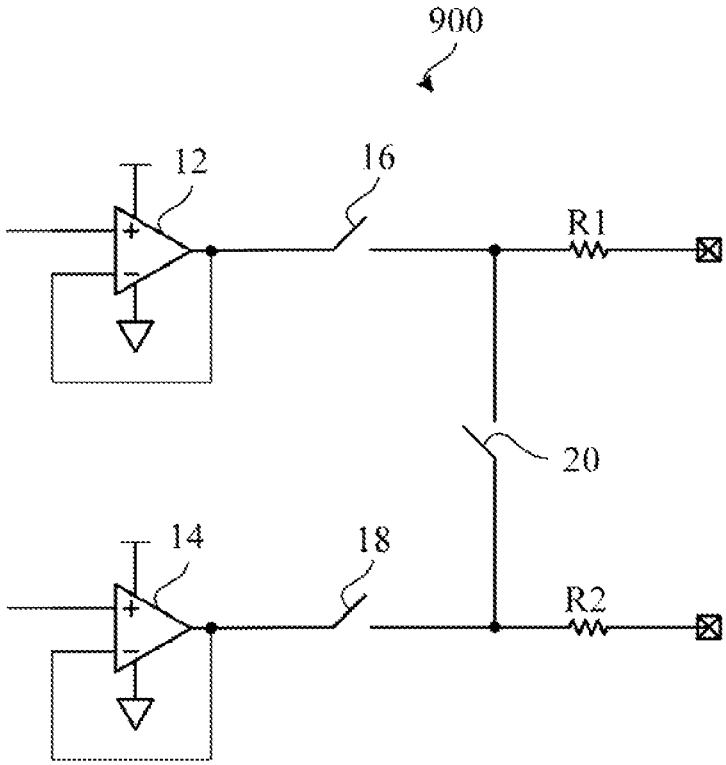
FIG. 3 (RELATED ART)
FIG. 3 is a schematic diagram of a source driver according to the prior art.

Further, the first resistor R11 is coupled between the first output switch 51 and the display panel 300, the second resistor R12 is coupled between the second output switch 52 and the display panel 300, the third resistor R21 is coupled between the third output switch 61 and the display panel 300, and the fourth resistor R22 is coupled between the fourth output switch 62 and the display panel 300. When the first output switch 51, the second output switch 52, the third output switch 61, and the fourth output switch 62 are simultaneously turned on or cut off, because the resistance of either of the first resistance R11, the second resistor R12, the third resistor R21, and the fourth resistor R22 is R, the resistance is not reduced, and the ESD protection of the source driver 200 is the same as that of the source driver 900 in FIG. 3.

Referring to FIG. 2, the source driver 200 further includes a plurality of first output stages S1, S2, . . . Sn coupled in parallel between the first output buffer 42 and the display panel 300, each of the first output stages includes an output switch and a resistor coupled in series. For example, the first output stage S1 includes the first output switch 51 and the first resistor R11 coupled in series, the first output stage S2 includes the second output switch 52 and the second resistor R12 coupled in series.

The source driver 200 further includes a plurality of second output stages D1, D2, . . . Dn coupled in parallel between the second output buffer 44 and the display panel 300, each of the second output stages includes the output switch and the resistor coupled in series. For example, the second output stage D1 includes the third output switch 61 and the third resistor R21 coupled in series, the second output stage D2 includes the fourth output switch 62 and the fourth resistor R22 coupled in series.

The source driver 200 further includes a plurality of charge-sharing switches 71, 72, . . . 7*n*, and the charge-sharing switches are respectively coupled between the first output stages and the second output stages. One end of each charge-sharing switch is coupled between the output switch and the resistor of the first output stage, the other end of each charge-sharing switch is coupled between the output switch and the resistor of the second output stage.

Alternative embodiments will become apparent to those skilled in the art without departing from the spirit and scope of what is claimed. Accordingly, the present invention should be deemed not to be limited to the above detailed description, but rather only by the claims that follow and equivalents thereof.

What is claimed is:

1. A source driver adapted to drive a display panel, the source driver comprising:

a first output buffer for enhancing a first pixel signal and outputting a first enhanced pixel signal to the display panel;

a second output buffer for enhancing a second pixel signal and outputting a second enhanced pixel signal to the display panel;

a first output switch, one end of the first output switch coupled to the first output buffer;

a second output switch, one end of the second output switch coupled to the first output buffer;

a first resistor coupled between the other end of the first output switch and the display panel;

a second resistor coupled between the other end of the second output switch and the display panel;

a third output switch, one end of the third output switch coupled to the second output buffer;

a fourth output switch, one end of the fourth output switch coupled to the second output buffer;

a third resistor coupled between the other end of the third output switch and the display panel;

a fourth resistor coupled between the other end of the fourth output switch and the display panel; and a first charge-sharing switch, one end of the first charge-sharing switch coupled between the first output switch and the first resistor, the other end of the first charge-sharing switch coupled between the third output switch and the third resistor; wherein the first charge-sharing switch performs a charge sharing function on the display panel;

wherein the first output switch, the second output switch, the third output switch, and the fourth output switch are simultaneously turned on or cut off by a first control signal.

2. The source driver of claim 1, further comprising:

a second charge-sharing switch, one end of the second charge-sharing switch coupled between the second output switch and the second resistor, the other end of the second charge-sharing switch coupled between the fourth output switch and the fourth resistor; wherein the second charge-sharing switch performs a charge sharing function on the display panel.

3. The source driver of claim 2, wherein the first charge-sharing switch and the second charge-sharing switch are simultaneously turned on or cut off by a second control signal.

4. The source driver of claim 1, further comprising a plurality of first output stages coupled in parallel between the first output buffer and the display panel, wherein each of the first output stages comprises an output switch and a resistor coupled in series.

5. The source driver of claim 4, further comprising a plurality of second output stages coupled in parallel between the second output buffer and the display panel, wherein each of the second output stages comprises an output switch and a resistor coupled in series.

6. The source driver of claim 5, further comprises a plurality of charge-sharing switches, the charge-sharing switches are respectively coupled between the first output stages and the second output stages, one end of each charge-sharing switch is coupled between the output switch and the resistor of the first output stage, the other end of each charge-sharing switch is coupled between the output switch and the resistor of the second output stage.

7. The source driver of claim 1, wherein the first resistor, the second resistor, the third resistor, and the fourth resistor are electrostatic discharge (ESD) protection resistors, and the resistance of each of the ESD resistors is equal.

8. A display apparatus, comprising:

a display panel, and a source driver adapted to drive the display panel, the source driver comprising:

a first output buffer for enhancing a first pixel signal and outputting a first enhanced pixel signal to the display panel;

a second output buffer for enhancing a second pixel signal and outputting a second enhanced pixel signal to the display panel;

a first output switch, one end of the first output switch coupled to the first output buffer;

a second output switch, one end of the second output switch coupled to the first output buffer;

a first resistor coupled between the other end of the first output switch and the display panel;

a second resistor coupled between the other end of the second output switch and the display panel;

a third output switch, one end of the third output switch coupled to the second output buffer;

a fourth output switch, one end of the fourth output switch coupled to the second output buffer;

a third resistor coupled between the other end of the third output switch and the display panel;

a fourth resistor coupled between the other end of the fourth output switch and the display panel; and a first charge-sharing switch, one end of the first charge-sharing switch coupled between the first output switch and the first resistor, the other end of the first charge-sharing switch coupled between the third output switch and the third resistor; wherein the first charge-sharing switch performs a charge sharing function on the display panel;

wherein the first output switch, the second output switch, the third output switch, and the fourth output switch are simultaneously turned on or cut off by a first control signal.

9. The display apparatus of claim 8, wherein the source driver further comprises:

a second charge-sharing switch, one end of the second charge-sharing switch is coupled between the second output switch and the second resistor, the other end of the second charge-sharing switch is coupled between the fourth output switch and the fourth resistor; the second charge-sharing switch performs a charge sharing function on the display panel.

10. The display apparatus of claim 9, wherein the first charge-sharing switch and the second charge-sharing switch are simultaneously turned on or cut off by a second control signal.

11. The display apparatus of claim 8, wherein the source driver further comprises a plurality of first output stages coupled in parallel between the first output buffer and the display panel, wherein each of the first output stages comprises an output switch and a resistor coupled in series.

12. The display apparatus of claim 11, wherein the source driver further comprises a plurality of second output stages coupled in parallel between the second output buffer and the display panel, wherein each of the second output stages comprises an output switch and a resistor coupled in series.

13. The display apparatus of claim 12, wherein the source driver further comprises a plurality of charge-sharing switches, the charge-sharing switches are respectively coupled between the first output stages and the second output stages, one end of each charge-sharing switch is coupled between the output switch and the resistor of the first output stage, the other end of each charge-sharing switch is coupled between the output switch and the resistor of the second output stage.

14. A source driver adapted to drive a display panel, the source driver comprising:

a first output buffer for enhancing a first pixel signal and outputting a first enhanced pixel signal to the display panel;

a second output buffer for enhancing a second pixel signal and outputting a second enhanced pixel signal to the display panel;

a plurality of first output stages coupled in parallel between the first output buffer and the display panel, each of the first output stages comprising a first output switch and a first resistor coupled in series;

a plurality of second output stages coupled in parallel between the second output buffer and the display panel, each of the second output stages comprising a second output switch and a second resistor coupled in series; and a plurality of charge-sharing switches, the charge-sharing switches respectively coupled between the first output stages and the second output stages, one end of each charge-sharing switch coupled between the first output switch and the first resistor of the first output stage, the other end of each charge-sharing switch coupled between the second output switch and the second resistor of the second output stage;

wherein the first output switches of the first output stages and the second output switches of the second output stages are simultaneously turned on or cut off by a first control signal.

15. The source driver of claim 14, wherein the charge-sharing switches are simultaneously turned on or cut off by a second control signal.

16. The source driver of claim 15, wherein the first output switches and the charge-sharing switches are not simultaneously turned on or cut off.

17. The source driver of claim 14, wherein the first resistors and the second resistors are electrostatic discharge (ESD) protection resistors.

18. The source driver of claim 17, wherein the resistance of each of the ESD resistors is equal.

* * * * *